US009273501B2

(12) United States Patent
De Morais et al.

(10) Patent No.: US 9,273,501 B2
(45) Date of Patent: Mar. 1, 2016

(54) TRIPLE-DETECTION DOUBLE-LOCKING PADDLE

(75) Inventors: José Bernardo De Morais, Chateauroux (FR); Michael Leveque, Chateauroux (FR)

(73) Assignee: Zodiac Seats France, Issoudun (FR)

( * ) Notice: Subject to any disclaimer, the term of this patent is extended or adjusted under 35 U.S.C. 154(b) by 273 days.

(21) Appl. No.: 13/876,504

(22) PCT Filed: Sep. 27, 2011

(86) PCT No.: PCT/EP2011/066794

§ 371 (c)(1),
(2), (4) Date: Aug. 5, 2013

(87) PCT Pub. No.: WO2012/041865

PCT Pub. Date: Apr. 5, 2012

(65) Prior Publication Data

US 2013/0307279 A1 Nov. 21, 2013

(30) Foreign Application Priority Data

Sep. 28, 2010 (FR) ..... 10 57803

(51) Int. Cl.
*E05C 1/02* (2006.01)
*E05C 19/10* (2006.01)
(Continued)

(52) U.S. Cl.
CPC ..... *E05C 19/10* (2013.01); *E05B 41/00* (2013.01); *E05B 63/14* (2013.01); *E05C 1/145* (2013.01);
(Continued)

(58) Field of Classification Search
CPC ..... E05C 3/00; E05C 3/006; E05C 3/04; E05C 3/047; E05C 3/048; E05C 3/06; E05C 3/08; E05C 3/12; E05C 3/122; E05C 3/124; E05C 3/14; E05C 3/16; E05C 3/162; E05C 3/22; E05C 3/30; E05C 3/34; E05C 1/12; E05C 1/14; E05C 1/145; Y10S 292/31
USPC ..... 292/100, 118, 126, 194, 195, 198, 200, 292/213, 217, 219, 220, 226, 336.3, 292/DIG. 31, 156, 161, 162
See application file for complete search history.

(56) References Cited

U.S. PATENT DOCUMENTS 362,152 A * 5/1887 Ferren ..... 292/210
986,659 A * 3/1911 Voight ..... 70/438
(Continued)

FOREIGN PATENT DOCUMENTS

CN 101517180 A 8/2009
CN 201391145 Y 1/2010
(Continued)

OTHER PUBLICATIONS

International Search Report for PCT/EP11/66794 (Dec. 14, 2011).
(Continued)

*Primary Examiner* — Carlos Lugo
(74) *Attorney, Agent, or Firm* — Kilpatrick Townsend & Stockton LLP; Dean W. Russell; Davidson G. Lucas

(57) ABSTRACT

This invention concerns mainly a handle system with two locking latches (7, 8) called "self-locking", independent one from the other for locking, but fitted with a single unlocking paddle (6). This system is fitted with indicators, which:
detect the door's opening and closing and
indicate separately the locking of the two latches (7, 8).

6 Claims, 5 Drawing Sheets

(51) Int. Cl.

| | |
|---|---|
| ***E05B 41/00*** | (2006.01) |
| ***E05B 63/14*** | (2006.01) |
| *E05C 1/08* | (2006.01) |
| *E05C 1/12* | (2006.01) |
| *E05C 1/14* | (2006.01) |
| *E05B 15/00* | (2006.01) |

(52) U.S. Cl.
CPC ..... *E05B 15/0006* (2013.01); *E05C 1/12* (2013.01); *E05C 1/14* (2013.01); *Y10S 292/31* (2013.01); *Y10T 292/0925* (2015.04)

(56) References Cited

U.S. PATENT DOCUMENTS

| | | | | |
|---|---|---|---|---|
| 2,272,909 | A * | 2/1942 | Fantl | 40/460 |
| 2,565,669 | A * | 8/1951 | Smith | 116/290 |
| 2,812,204 | A * | 11/1957 | Squire | E05C 1/145 292/169.14 |
| 3,304,756 | A * | 2/1967 | Eads | 70/432 |
| 3,743,336 | A * | 7/1973 | Andrews | 292/173 |
| 4,170,119 | A * | 10/1979 | Kalis, Jr. | E05C 1/145 292/173 |
| 6,109,669 | A * | 8/2000 | Pinkow | 292/175 |
| 6,357,806 | B1 * | 3/2002 | Saku | 292/182 |
| 6,547,289 | B1 | 4/2003 | Greenheck et al. | |
| 6,561,557 | B2 * | 5/2003 | Choi | 292/336.3 |
| 6,626,472 | B1 * | 9/2003 | Berg | 292/336.3 |
| 6,715,225 | B1 * | 4/2004 | Frolov et al. | 40/570 |
| 6,719,332 | B2 * | 4/2004 | Sekulovic | 292/170 |
| 7,083,205 | B2 * | 8/2006 | Hall | 292/34 |
| 7,182,374 | B2 * | 2/2007 | Figge et al. | 292/334 |
| 7,204,050 | B2 * | 4/2007 | Molokotos et al. | 40/570 |
| 7,399,009 | B2 * | 7/2008 | Hall et al. | 292/100 |
| 7,552,954 | B2 * | 6/2009 | Rozo et al. | 292/336.3 |
| 7,699,365 | B2 * | 4/2010 | Liang et al. | 292/240 |
| 7,798,540 | B1 * | 9/2010 | Vitry et al. | 292/216 |
| 7,819,442 | B2 * | 10/2010 | Ieda et al. | 292/336.3 |
| 8,876,177 | B2 * | 11/2014 | Takada et al. | 292/336.3 |
| 2005/0077735 | A1 * | 4/2005 | Generowicz et al. | 292/241 |
| 2008/0129054 | A1 | 6/2008 | Tremble et al. | |

FOREIGN PATENT DOCUMENTS

| | | | | |
|---|---|---|---|---|
| DE | 20017674 | | 12/2000 | |
| EP | 1526236 | A2 * | 4/2005 | B62D 33/037 |
| GB | 2322902 | | 9/1998 | |
| GB | 2437620 | | 10/2007 | |
| GB | 2439212 | | 12/2007 | |
| JP | 3979932 | B2 | 9/2007 | |
| KR | 100818235 | * | 4/2008 | |
| WO | WO 2005026481 | A2 * | 3/2005 | |
| WO | 2010004039 | | 1/2010 | |

OTHER PUBLICATIONS

Chinese Patent Application No. 201180055248.2, Office Action (including English Translation) dated Sep. 3, 2014.

Chinese Patent Application No. 201180055248.2, Office Action (including English Translation) dated Apr. 27, 2015.

* cited by examiner

TRIPLE-DETECTION DOUBLE-LOCKING PADDLE

CROSS-REFERENCE TO RELATED APPLICATIONS

This application is the U.S. national phase of International Application No. PCT/EP2011/066794 filed on Sep. 27, 2011, which application claims priority to French Patent Application No. 1057803 filed on Sep. 28, 2010, the contents of both of which are incorporated herein by reference.

TECHNICAL FIELD OF THE INVENTION

The invention concerns a handle system with double-locking and triple detection, designed to be attached to a hinged panel. The invention finds a particularly advantageous application in the field of aeronautical products fitted with hinged panels.

STATE OF THE ART

Aeronautical products fitted with hinges such as doors, cuffs or other types of openings not benefiting from an exemption according to standard AC.25.17-A are subject to a double-locking obligation. To comply with this specification, most of the time, these hinged panels, hereinafter referred to as doors, are fitted either with two locks with independent paddles, or with locks with 2 bolts, one self-locking and the other to be operated at each locking and unlocking. The latter are often fitted with lock status indicators.

Document DE 200 17 674 describes a handle system comprising a handle body and an unlocking paddle able to turn around an axis of rotation to change the door from a closed position to an open position. Two locking latches can change from a locked position, wherein the latches cooperate with openings realized in the door, to an unlocked position wherein these latches are disengaged from the openings in the door.

In the system described in this document, a single means of detection is used to indicate a fault in closing the door or faulty locking. Effectively, when the surface of the handle is visible, it can be seen that there is a closing or locking fault, but the cause of this fault cannot be known, i.e. whether one or both latches are unlocked or whether the door is open.

SUBJECT OF THE INVENTION

The aim of the invention is to solve this drawback by proposing a completely mechanical handle system, which is able to detect the opening/closing of a door and the locking/unlocking of the latches and that complies better with aeronautics standards.

To this end, the handle system according to the invention comprises first mechanical means for detecting the locking or unlocking of the locking latches, as well as second mechanical means for detecting the opening and closing of the door, independently of the first mechanical means.

The invention concerns, therefore, a handle system intended to be attached to a door comprising:

- a handle body;
- an unlocking paddle able to turn about an axis of rotation to change the door from a closed position to an open position and vice versa;
- two locking latches that can change from a locked position wherein the latches cooperate with openings made in the door, to an unlocked position wherein these latches are disengaged from the door's openings, where these latches can be actuated by the unlocking paddle;

characterized in that it comprises, in addition:

- first mechanical means for detecting the locking or unlocking of the locking latches and
- second mechanical means for detecting the opening and closing of the door, independently of the first mechanical means.

According to an embodiment, the first mechanical means consist of indicators associated with the latches used in combination with transparent windows.

According to an embodiment, the second mechanical means comprise a detection finger cooperating with the unlocking paddle, with this finger being able to cover the indicators when the door is in the open position.

According to an embodiment, the detection finger is able to keep the unlocking paddle in a raised position in relation to the handle body.

According to an embodiment, the two locking latches and the detection finger are mobile in translation in relation to the handle body along a direction substantially parallel to the axis of rotation of the unlocking paddle, the two latches and the detection finger being connected with the handle body by means of a return spring, which tends to push these elements in a direction that corresponds to the latches' locked position.

According to an embodiment, the return spring of the detection finger has a stiffness constant higher than that of the springs associated with the latches.

According to an embodiment, the extremity of the detection finger has a V-shaped cross-section; this extremity being able to cooperate with the unlocking paddle to keep it in the raised position.

According to an embodiment, when the door is in the closed position, the extremity of the detection finger cooperates with an interface of the door that forms an angle of 25 to 60 degrees with the handle body's extension plane to apply a residual force higher than the weight of the door.

According to an embodiment, the system comprises pilot holes made in the edges of the handle body, designed to receive centering studs attached to the door.

BRIEF DESCRIPTION OF THE FIGURES

The invention will be better understood in reading the following description and examining the figures pertaining thereto. These figures are given as a non-limiting illustration of the invention. They show.

Figure 1:
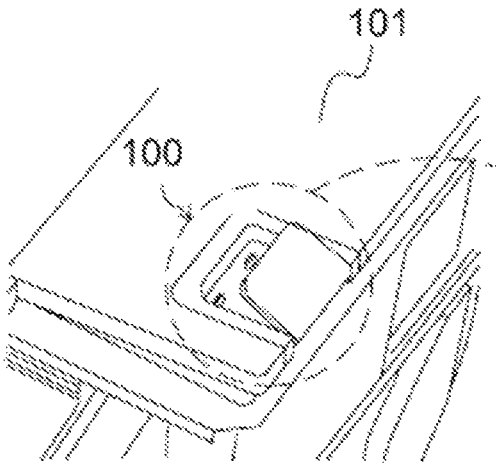
FIG. 1: a 3D view of a door fitted with a handle system according to the invention in the open position.
Figure 2:
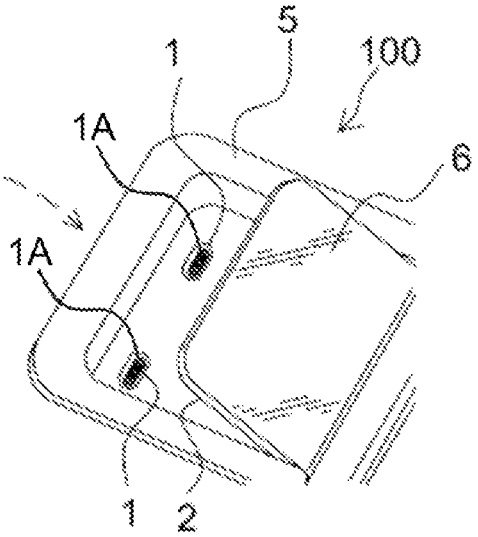
FIG. 2: a detail view of the handle system of FIG. 1.
Figure 3:
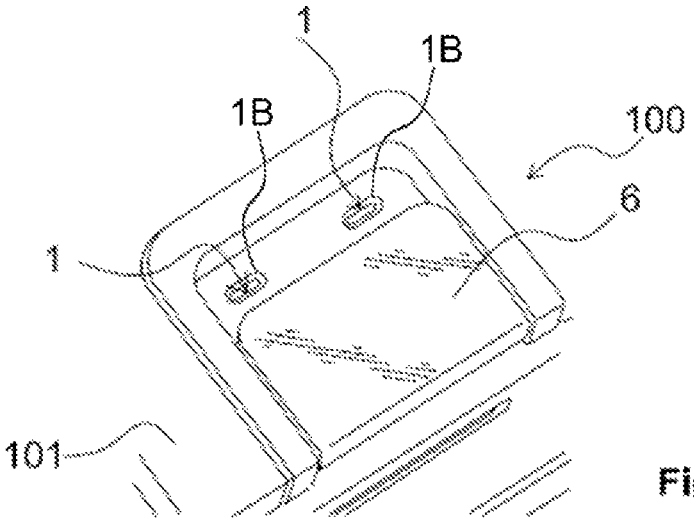
FIG. 3: a view of the handle system in FIG. 1 when the door is in the closed position.
Figure 4:
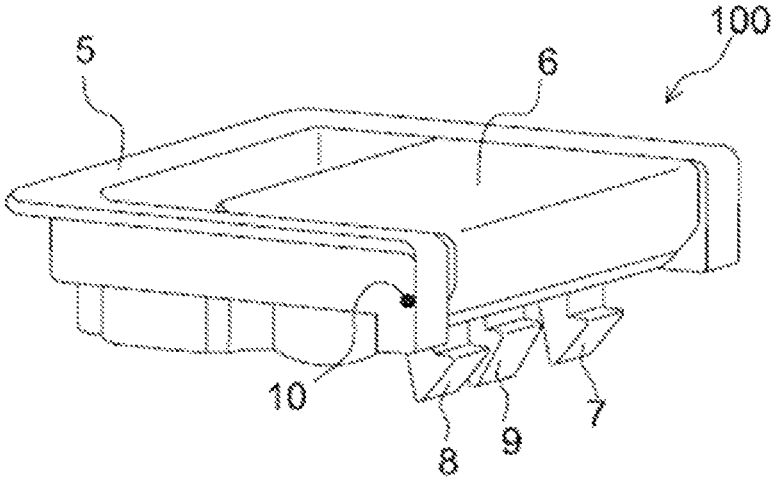
FIG. 4: a perspective view of the handle system according to the invention.

Identical, similar or analogous elements retain the same references in all the figures.

DESCRIPTION OF A PREFERRED EXAMPLE OF REALIZATION OF THE INVENTION

FIGS. 1 to 7 show a handle system 100 designed to be attached to a door 101 comprising a handle body 5 and a single unlocking paddle 6 able to turn around an axis of rotation 10 to change the door 101 from a closed position to an open position and vice-versa. This paddle 6 comprises a small and a large portion in the shape of paddles perpendicular to each other. The axis 10 is located for example at the junction between the small and large portion or at an edge of the extremity of the small portion of the paddle 6 facing the junction between the two portions of the paddle 6.

This system 100 also comprises two locking latches 7, 8 called "self-locking", independent one from the other for locking. These latches 7 and 8 can change from a locked position wherein the latches 7, 8 cooperate with openings provided in the door 101, to an unlocked position wherein these latches 7, 8 are disengaged from the opening of the door 101 and vice versa. These latches 7, 8 can be actuated by the unlocking paddle 6.

First mechanical means 1 provide the detection of locking or unlocking of the locking latches 7, 8. These first mechanical means 1 are formed by indicators associated with the latches 7, 8 used in conjunction with transparent windows provided in the side of the bottom of a hollow in the body 5, inside which paddle 6 is positioned.

In addition, second mechanical means 9 provide the detection of the opening and closing of the door 101. These second mechanical means comprise in particular a detection finger 9 cooperating with the unlocking paddle 6, this finger 9 being able to cover the latches' indicators using portion 9A when the door 101 is in the open position.

More specifically, the two locking latches 7, 8 and the detection finger 9 with an elongated shape are mobile in translation in relation to the handle body 5 along a direction that is substantially perpendicular to the unlocking paddle's axis of rotation 10 and located in the plane of the larger portion of the paddle 6 when the latter is in the closed position.

At their extremity opposite the one located on the side of the locking indicators, the two latches 7, 8 have hooks designed to cooperate with complementary openings in the door 101 to ensure its locking.

One extremity of the detection finger 9, opposite that located on the side of the locking indicators, has a V-shape cross-section. This extremity is able to cooperate with the unlocking paddle 6 to keep it in the raised position.

Figure 5:
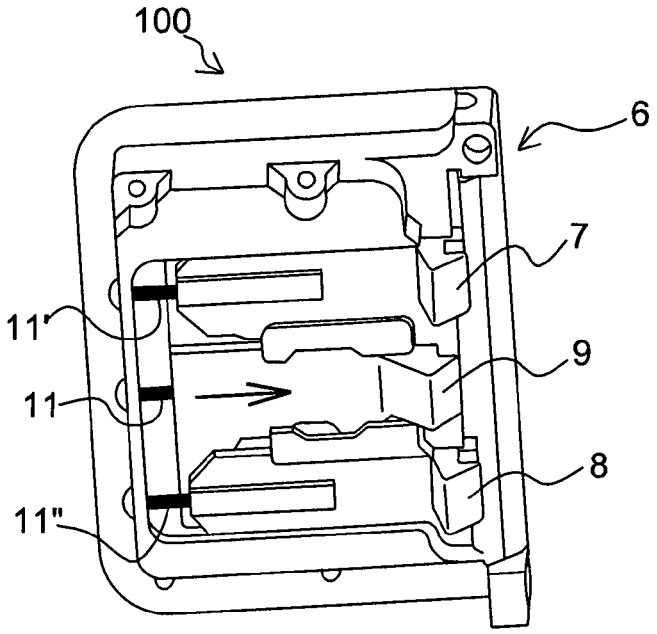
FIG. 5: a bottom view of the handle system according to the invention.

On the locking indicator side, the extremities of the two latches 7, 8 and of the detection finger 9 are each connected to the handle body 5 by means of a return spring 11, 11', 11" that tends to push these elements 7, 8, 9 in a direction that corresponds with the locked position of the latches 7, 8 (i.e. from left to right in FIG. 5). The detection finger return spring 11 has a stiffness constant greater than that of the springs 11', 11" associated with the latches 7, 8.

Figure 6:
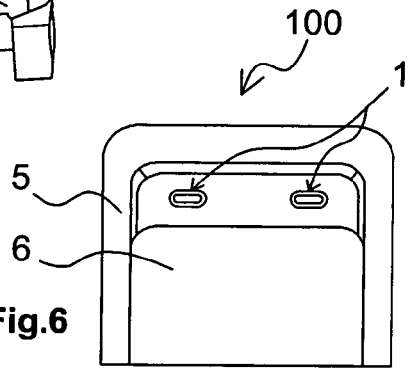
FIG. 6: a top view of the system with the indicators showing the lock status of the latches (when the door is in the closed position)

Such a system thus makes it possible to detect the opening and closing of the door 101 using the means 1 when the paddle 6 is in the raised position and detects independently the locking of the two latches 7 and 8, as shown in FIG. 6.

Effectively, since the detection finger 9 works with the return spring 11 when this finger 9 is out, it takes priority over the two locking latches 7 and 8 by actuating two indicators into the "not closed" position and by maintaining the paddle in the raised position 2. In this configuration, the door 101 remained open (see FIG. 2).

The detection finger 9 retracts when the door 101 closes, thus clearing the view of the indicators of the locking latches 7 and 8. Effectively, each of the latches 7 and 8 is fitted with locking indicators 1B (see FIGS. 3 and 6) visible when the latches 7, 8 are locking the door 101 and with unlocking indicators 1A visible when the latches 7, 8 unlock the door 101, thus allowing the door 101 to be opened. The locking indicators 1B could for example take the form of green paint or of a written indication ("Closed", "Fermé" or such, depending on the country); whereas the unlocking indicators 1A could for example take the form of red paint or of a written indication ("Open", "Ouvert" or such, depending on the country).

Figure 7:
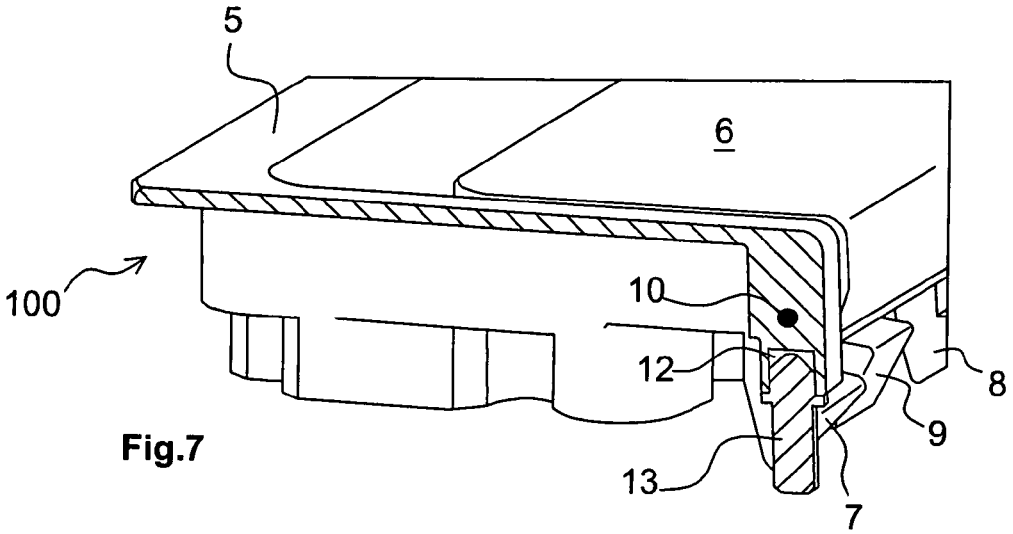
FIG. 7: a cutaway side view of the handle system according to the invention along a longitudinal plane fitted with centering holes.

As can be seen in FIG. 7, in order to make the operation of the system 100 secure, the handle is fitted with pilot holes 12 made in the edges of the handle body 5 wherein centering studs 13 fitted with return springs come to rest. The aim of this device is to guarantee a constant and sufficient penetration size, irrespective of the system's flexibility, i.e. its tolerance.

Figure 8A:
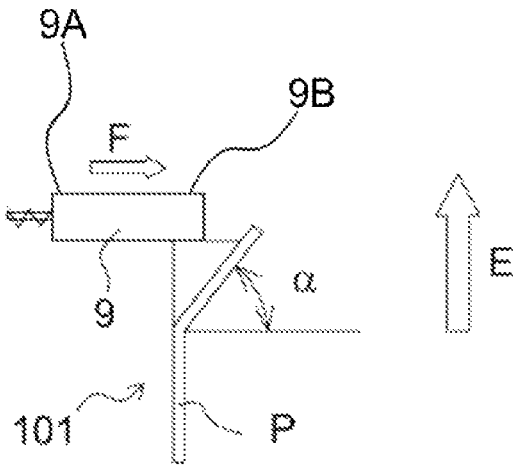
FIGS. 8*a*, 8*b*: schematic representations of the extremity of a detection finger according to the invention used in combination or not with studs exerting a continuous return force.
Figure 8B:
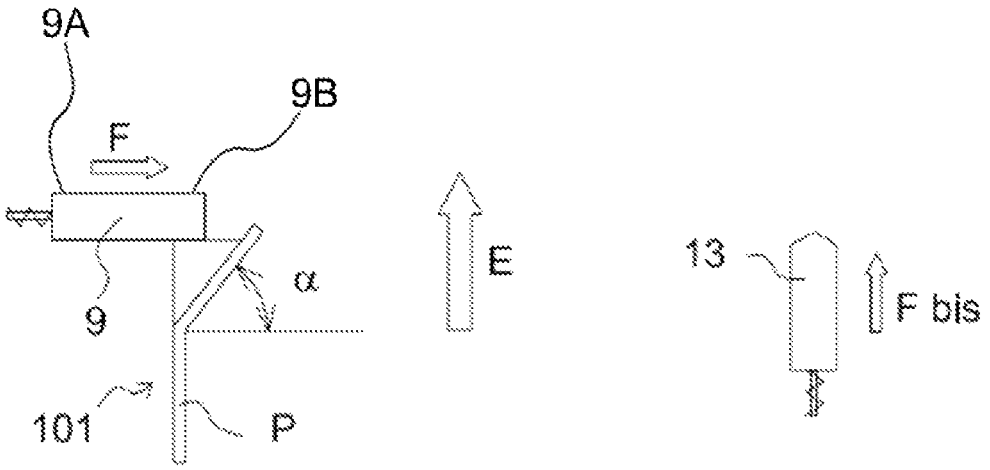
Figure 9:
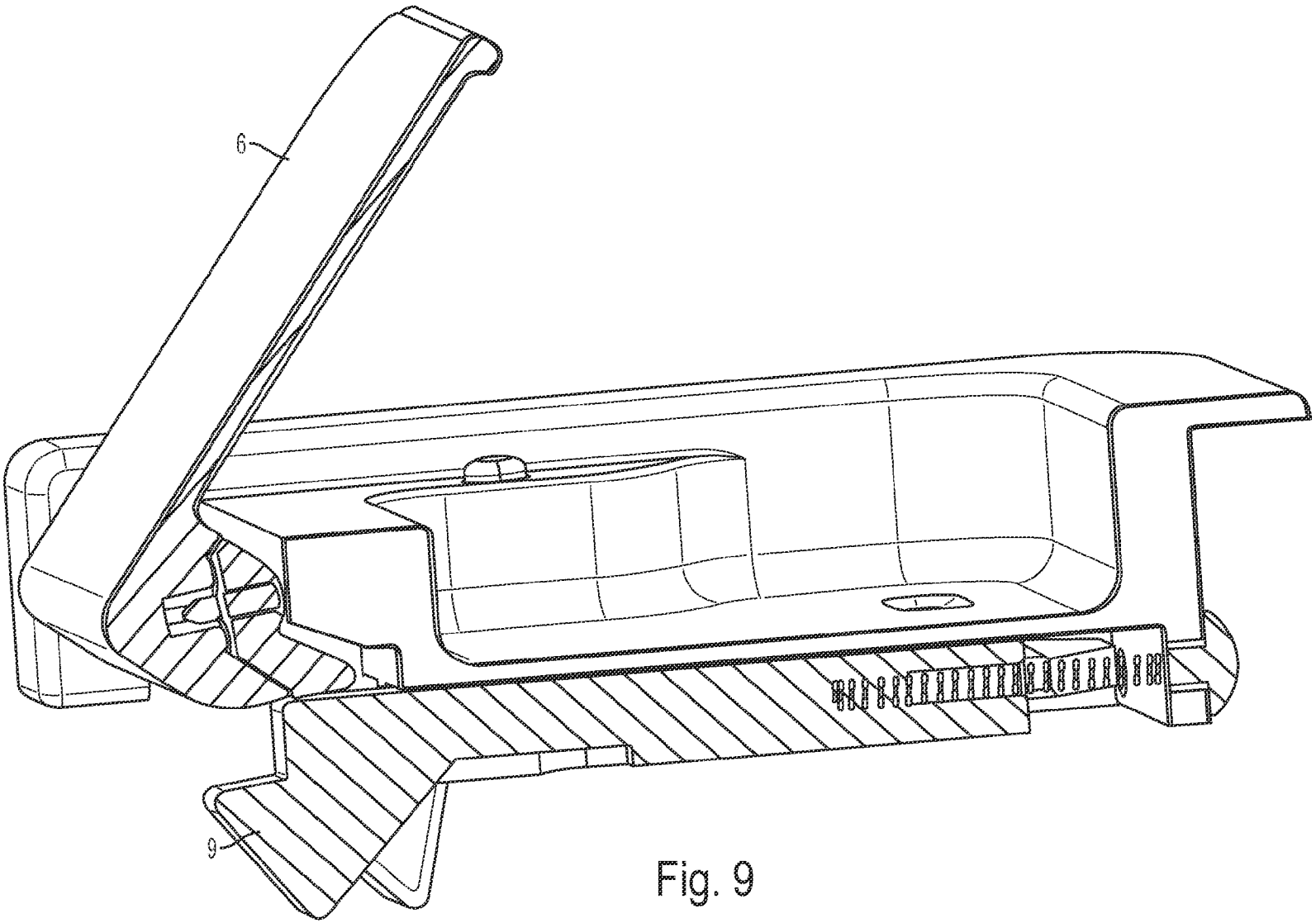
FIG. 9: a cutaway view of the handle system in the open position.
Figure 10A:
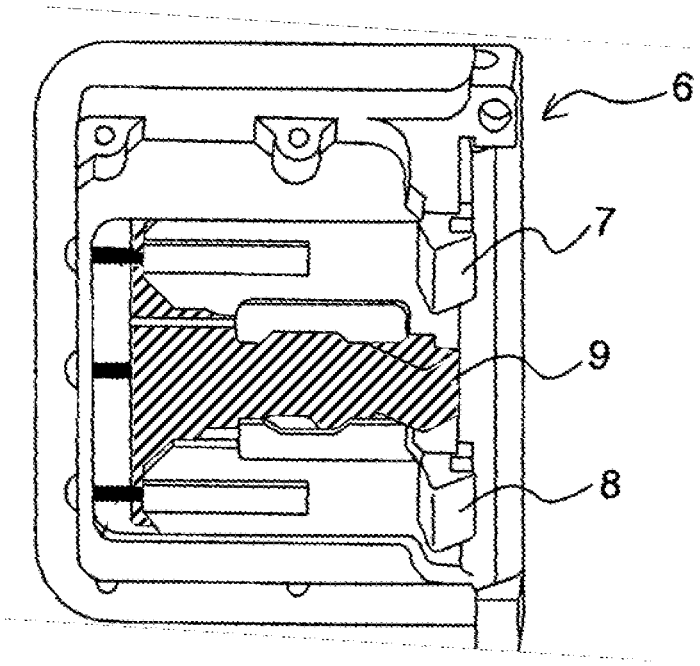
FIG. 10*a*: a bottom view of the handle system in the open position.
Figure 10B:
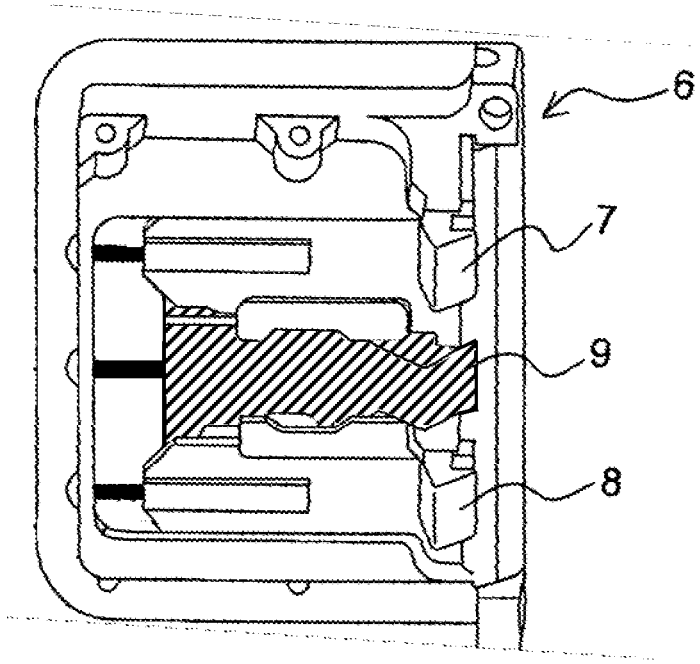
FIG. 10*b*: a bottom view of the handle system in the closed position.

The finger 9, fitted with indicators 1, keeps the door 101 open, i.e. in a raised position in relation to the handle body 5, as long as the latches 7 or 8 are not locking the door 101. To this end, as shown in FIGS. 8*a* and 8*b*, the return spring 11 exerts a continuous return force F on the detection finger 9. The extremity of the finger 9 (portion 9B) cooperates with a section of the door 101, marked P in FIGS. 8*a* and 8*b*. The angle $\alpha$ of section P to the horizontal is preferably between 25 and 60 degrees. The finger 9 exerts a residual force E greater than the weight of the door 101 in a direction substantially perpendicular to the plane of the door 101 when the latter is in the closed position. This device can be supplemented by assistance from the pin 13 in cases where the weight of the door 101 is high, this pin 13 then exerting a force Fb (see FIG. 8*b*).

When the door 101 is in the closed position, the extremity of the detection finger 9 (portion 9B) cooperates with an interface of the door 101 that forms an angle $\alpha$ of 25 to 60 degrees with the extension plane of the handle body 5 to apply a residual force greater than the weight of the door 101.

The invention claimed is:

1. A handle system intended to be attached to a door, which comprises:

a handle body;

an unlocking paddle able to turn about an axis of rotation to change the door from a closed position to an open position and vice versa;

two locking latches that can change from a locked position, wherein the latches cooperate with openings realized in the door, to an unlocked position wherein these latches are disengaged from the openings in the door, where these latches can be actuated by the unlocking paddle;

further comprising:

first mechanical means for detecting the locking or unlocking of the locking latches, wherein the first mechanical means consist of indicators associated with the latches used in combination with transparent windows and second mechanical means for detecting the opening and closing of the door, wherein the second mechanical means comprise a detection finger cooperating with the unlocking paddle, with the finger being able to cover the latches' indicators when the door is in the open position, wherein the detection finger is able to keep the unlocking paddle in a raised position in relation to the handle body.

2. The handle system according to claim 1, further comprising pilot holes made in the edges of the handle body, designed to receive centering studs attached to the door.

3. A handle system intended to be attached to a door, which comprises:

a handle body;

an unlocking paddle able to turn about an axis of rotation to change the door from a closed position to an open position and vice versa;

two locking latches that can change from a locked position, wherein the latches cooperate with openings realized in the door, to an unlocked position wherein these latches are disengaged from the openings in the door, where these latches can be actuated by the unlocking paddle;

further comprising:

first mechanical means for detecting the locking or unlocking of the locking latches, wherein the first mechanical means consist of indicators associated with the latches used in combination with transparent windows and second mechanical means for detecting the opening and closing of the door, wherein the second mechanical means comprise a detection finger cooperating with the unlocking paddle, with the finger being able to cover the latches' indicators when the door is in the open position, wherein the two locking latches and the detection finger are mobile in translation in relation to the handle body along a direction substantially perpendicular to the axis of rotation of the unlocking paddle; and wherein the two locking latches and the detection finger are connected with the handle body by means of a return spring, which tends to push these elements in a direction that corresponds to the latches' locked position.

4. The handle system according to claim 3, wherein the detection finger return spring has a stiffness constant greater than that of the return springs associated with the latches.

5. The handle system according to claim 3, wherein an extremity of the detection finger cooperates with an interface of the door that forms and angle ($\alpha$) of 25 to 60 degrees with an extension plane of the handle body, when the door is in the closed position, so as to apply a residual force greater than the weight of the door.

6. A handle system intended to be attached to a door, which comprises:

a handle body;

an unlocking paddle able to turn about an axis of rotation to change the door from a closed position to an open position and vice versa;

two locking latches that can change from a locked position, wherein the latches cooperate with openings realized in the door, to an unlocked position wherein these latches are disengaged from the openings in the door, where these latches can be actuated by the unlocking paddle;

further comprising:

first mechanical means for detecting the locking or unlocking of the locking latches, wherein the first mechanical means consist of indicators associated with the latches used in combination with transparent windows and second mechanical means for detecting the opening and closing of the door, wherein the second mechanical means comprise a detection finger cooperating with the unlocking paddle, with the finger being able to cover the latches' indicators when the door is in the open position, wherein an extremity of the detection finger has a V-shaped cross section, the extremity being able to cooperate with the unlocking paddle to keep it in a raised position.

* * * * *